US005967303A

United States Patent [19]

Kurek et al.

[11] Patent Number: 5,967,303

[45] Date of Patent: Oct. 19, 1999

[54] SWITCH ACTIVATING MECHANISM

[75] Inventors: Stephen R. Kurek, Rego Park; Paul Kadar, Seaford, both of N.Y.

[73] Assignee: Leviton Manufacturing Co., Inc., Little Neck, N.Y.

[21] Appl. No.: 09/183,050

[22] Filed: Oct. 30, 1998

[51] Int. Cl.[6] ..... H01H 21/82

[52] U.S. Cl. ..... 200/559; 200/688

[58] Field of Search ..... 200/6 R–6 C, 200/16 R, 16 C, 160, 553, 557, 558, 559, 332, 335

[56] References Cited

U.S. PATENT DOCUMENTS

| | | | |
|---|---|---|---|
| 3,082,309 | 3/1963 | Carissimi | 200/153 |
| 3,311,716 | 3/1967 | Carlson | 200/6 |
| 3,944,773 | 3/1976 | Schumacher | 200/293 |
| 4,181,825 | 1/1980 | Epple | 200/1 V |
| 4,241,244 | 12/1980 | Swann | 200/6 R |
| 4,689,450 | 8/1987 | Sawada | 200/6 R |
| 5,382,768 | 1/1995 | Kurek et al. | 200/556 |
| 5,473,130 | 12/1995 | Pudims | 200/559 |

*Primary Examiner*—Michael Friedhofer
*Attorney, Agent, or Firm*—Paul J. Sutton

[57] ABSTRACT

A double pole, single throw switch for high current applications employs two sets of contacts, closed or opened by a toggle lever operating movable contacts on resilient arms into and out of engagement with fixed contacts. The chambers containing the sets of contacts are separated from a spring chamber which contains a flat spring to control the orientation of the toggle lever. Barriers between the spring chamber and each of the contact chambers prevents flashover between the contact sets.

14 Claims, 9 Drawing Sheets

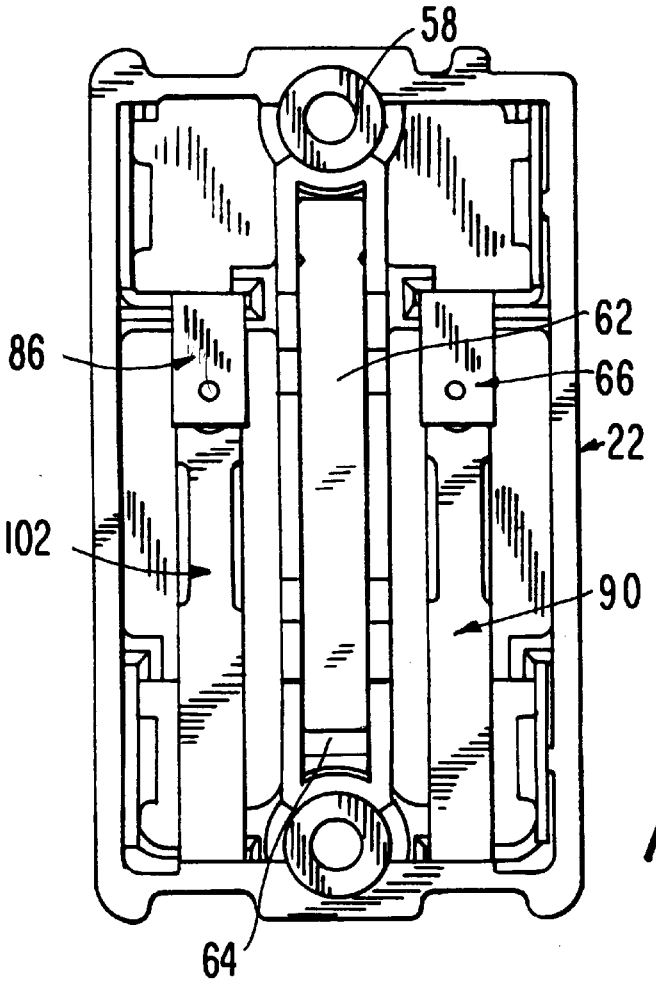
FIG. 5
FIG. 10
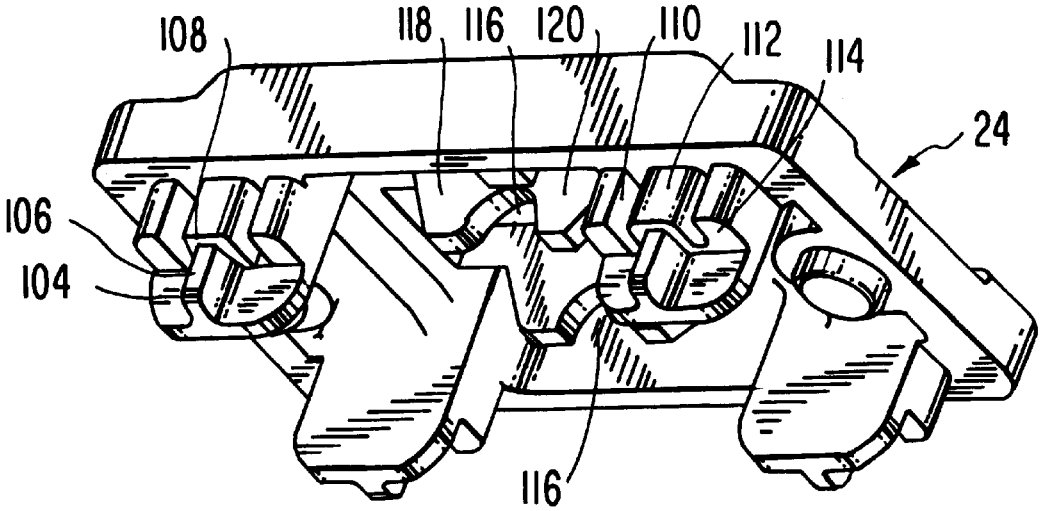

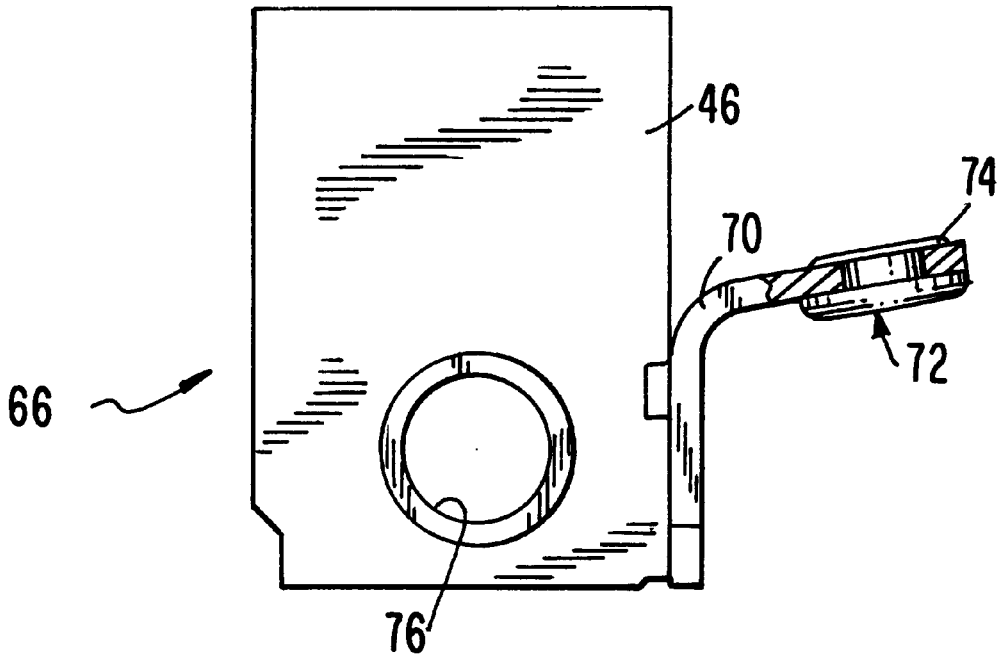
FIG. 6
FIG. 7
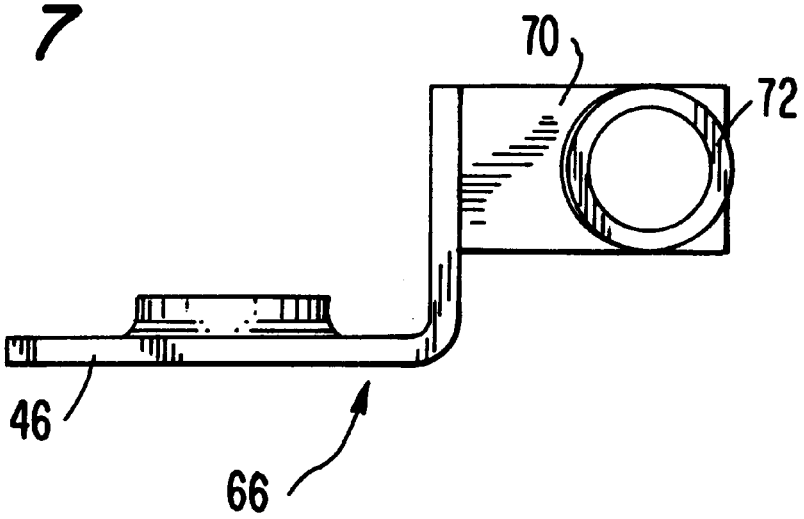

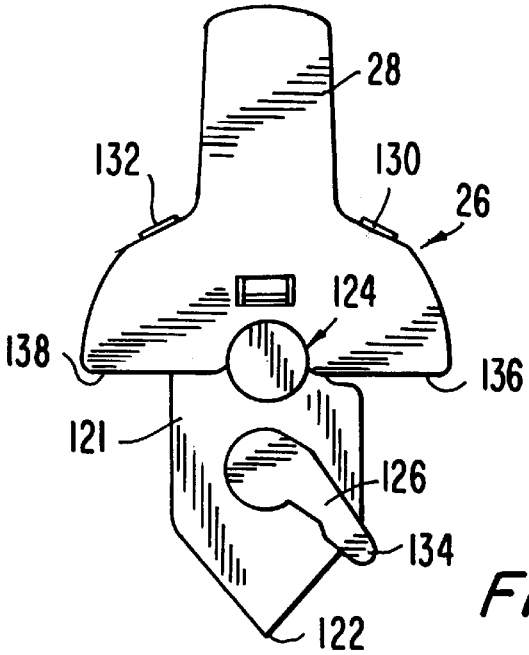
FIG. 11
FIG. 13
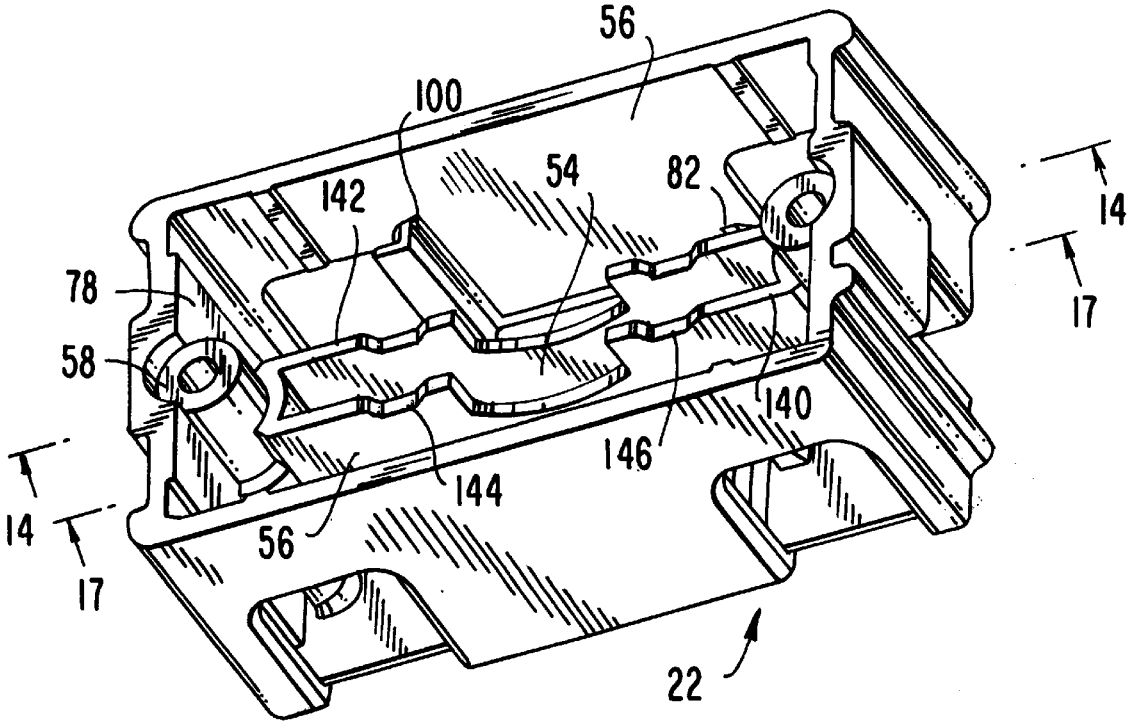

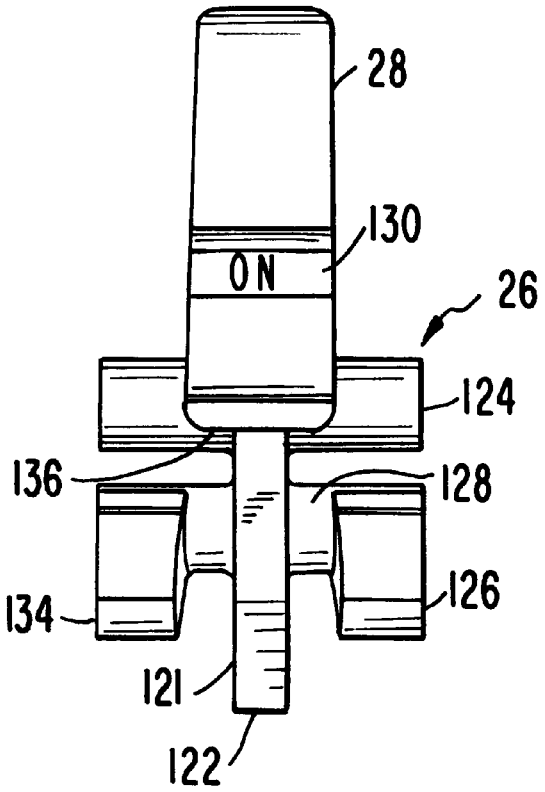
FIG. 12
FIG. 14
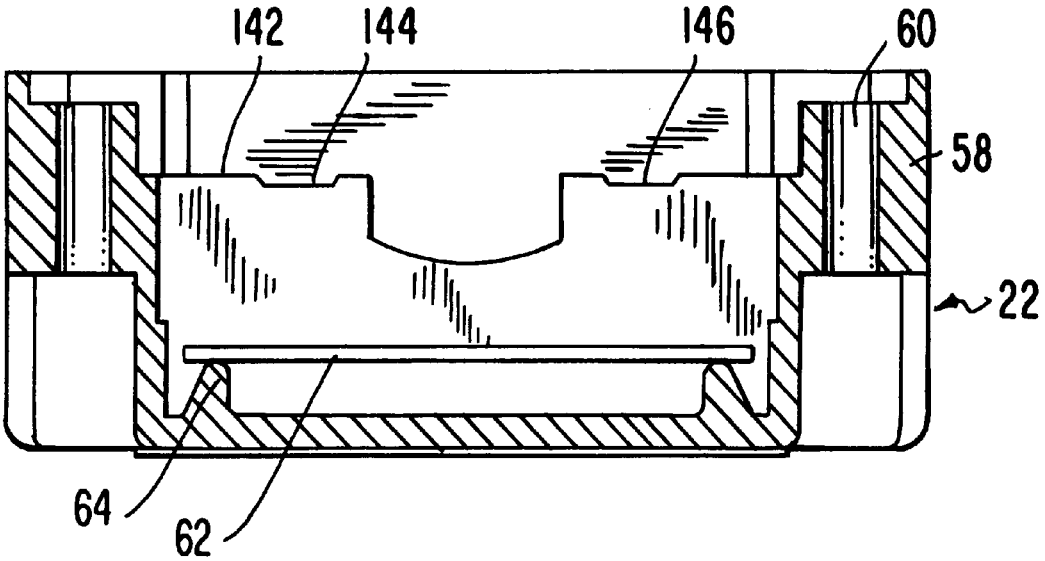

SWITCH ACTIVATING MECHANISM

BACKGROUND OF THE INVENTION

1. Field of the Invention

The invention is directed to electrical switches for switching high current sources to high current loads.

2. Description of the Prior Art

Prior art switches use coil springs to engage the toggle lever and establish the open and closed positions of the switch. When used in high current applications the proximity of the contacts and the coil spring could lead to flashover, which could destroy or damage the switch. Attempts to place barriers within the switch housing between the coil spring and each of the sets of contacts resulted in a switch too wide to fit within enclosures such as a standard single gang box. The width of the switch could be decreased by decreasing the diameter of the coil spring and putting thin barriers between the coil spring and each of the sets of contacts. This generally made the switch unusable for high current situations.

SUMMARY OF THE INVENTION

The present invention overcomes the problems noted above with respect to prior art devices by providing a flat spring to engage one end of the toggle lever and fix the two orientations of such lever. The flat spring is much narrower than a coil spring diameter while providing two distinct over-center positions for the toggle lever. With the use of the flat spring the barriers between the flat spring and the contacts can be made to a thickness which prevents flashover while keeping the outer dimensions small enough to permit wide general use, for example, in a standard gang box. It is an object of this invention to provide a novel switch activating mechanism.

It is an object of this invention to provide a novel switch activating mechanism, which has small exterior dimensions.

It is another object of this invention to provide a novel switch activating mechanism, which employs a flat spring.

It is yet another object of this invention to provide a novel switch activating mechanism which employs a flat spring and has interior barriers to prevent flashover between the elements of the switch.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWINGS

In the drawing in which similar elements are given similar reference characters:

FIG. 5 is the same as FIG. 4 with the flat spring installed in the body portion.

FIG. 6 is a side elevational view, partially in section, of a fixed contact with its conductor coupling plate attached.

FIG. 7 is a top plan view of the contact of FIG. 6.

FIG. 10 is an isometric view of the cover portion of the switch of FIG. 1.

FIG. 11 is a side elevational view of the toggle lever of the switch of FIG. 1.

FIG. 12 is a front elevational view of the toggle lever of FIG. 11.

FIG. 13 is an isometric view of the body portion of the switch of FIG. 1 with the operating parts removed.

FIG. 14 is a side elevational view of the body portion, partly in section, taken along the lines 14—14 in FIG. 13 with the flat spring installed.

DESCRIPTION OF THE PREFERRED EMBODIMENT

Figure 1:
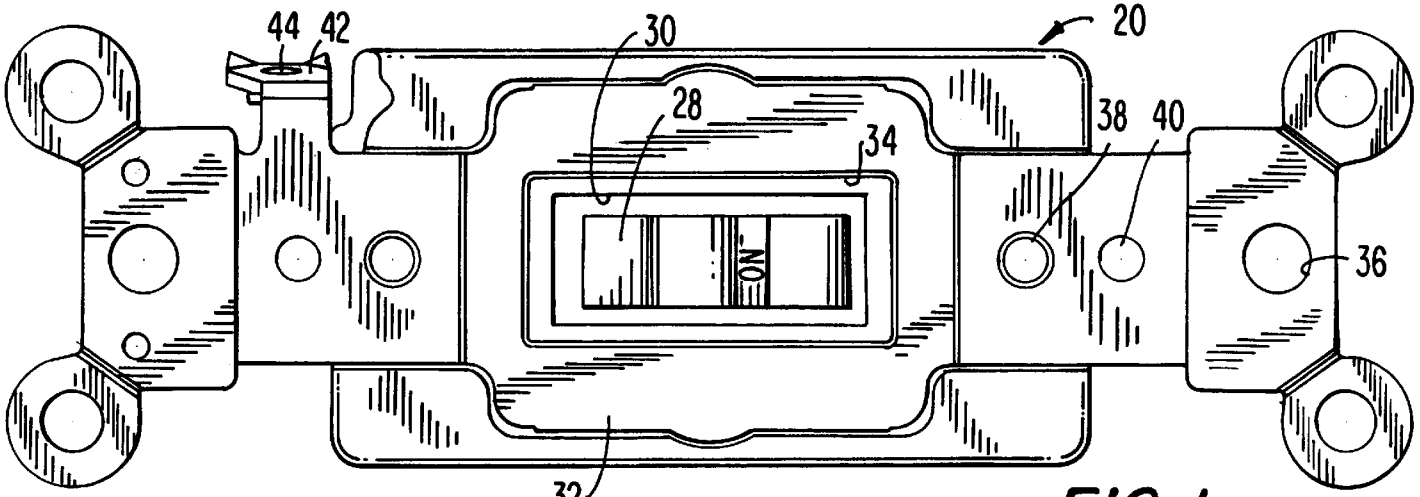
FIG. 1 is a top plan view of a switch constructed in accordance with the concepts of the invention.
Figure 2:
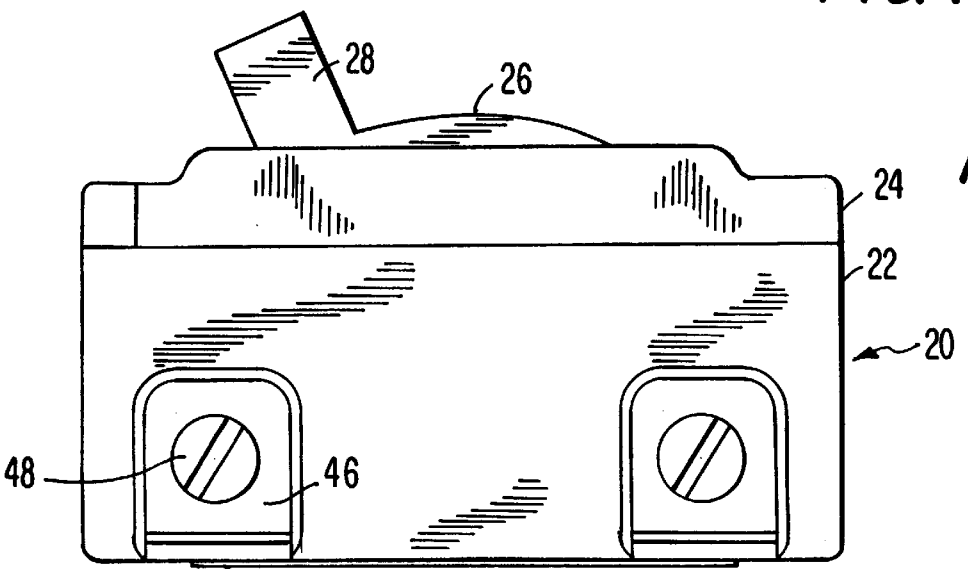
FIG. 2 is a side elevational view of the switch of FIG. 1 with the mounting strap removed.
Figure 3:
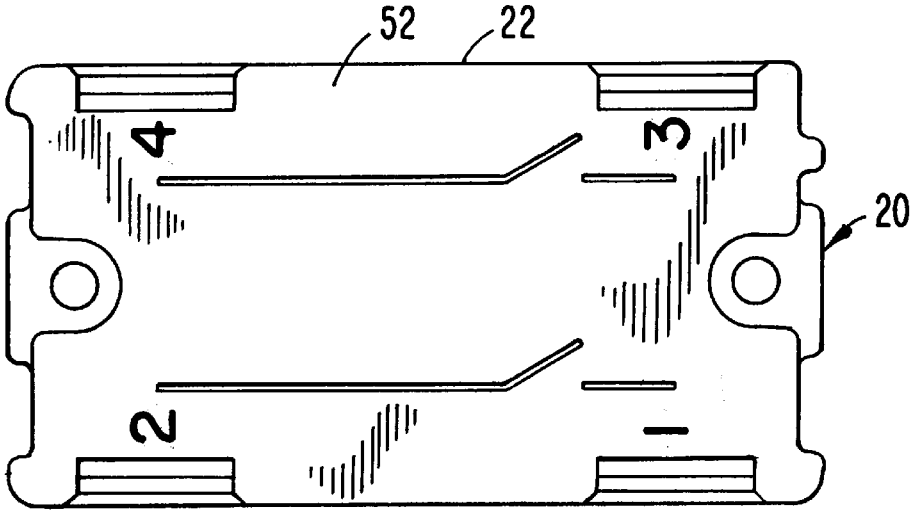
FIG. 3 is a bottom plan view of the body portion of the switch of FIG. 1.

FIGS. 1, 2 and 3 show a switch 20 having a body portion 22 and a cap 24. A toggle lever 26 has an actuating portion 28 which extends through an aperture 30 in cap 24 to where it can be engaged by a user to set the toggle lever 26 in one of two stable orientations. A mounting strap 32 has an aperture 34 aligned with aperture 30 so that the actuating portion 28 can extend through the mounting strap 32. Apertures 36 permit the switch 20 to be fastened to the mounting ears of a standard single gang box (not shown) as is well known in the art. Apertures 38 permit a fastener (not shown) to be used to hold the body portion and cap in assembly and apertures 40 are threaded to receive the screws of a cover plate (not shown) to be placed over the switch 20. A ground tab 42 is formed on the mounting strap 32 and has a threaded aperture 44 into which a screw (not shown) is inserted to receive a grounding conductor thereabout and ground the mounting strap 32. The contacts within the body portion 22, as will be described below, each terminate in a conductor coupling plate 46 which have threaded apertures 76 to receive terminal screws 48 to fasten the bared ends of insulated conductors (not shown) to the conductor coupling plates. The bottom outside surface 52 is marked to show the switching arrangements which can be achieved with switch 20. A first conductor can be connected to a second conductor or left open and a third conductor can be connected to a fourth conductor or left open. In either operation, both switches must be closed or left open, one can not be operated independently of the other.

Figure 4:
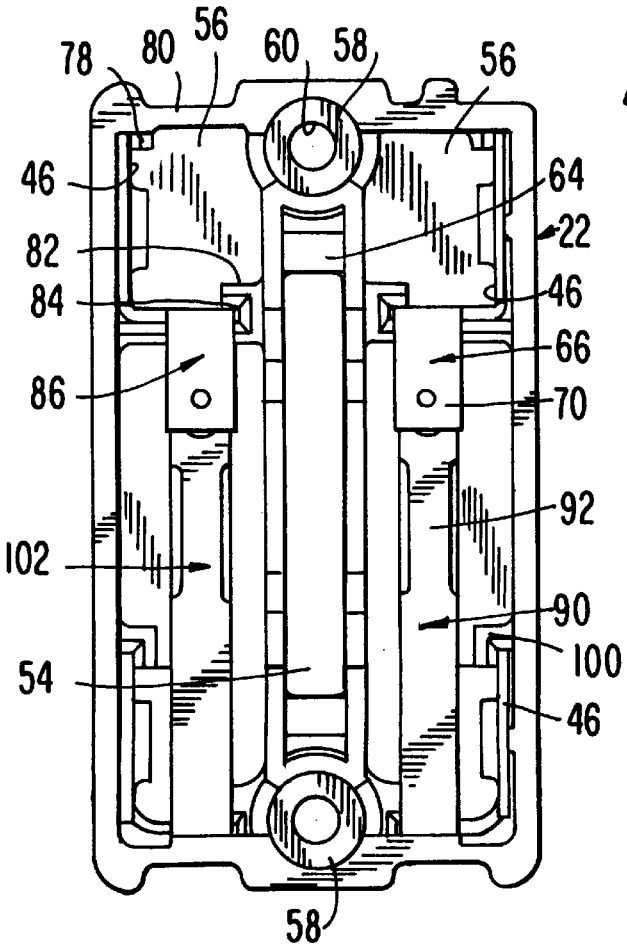
FIG. 4 is a top plan view of the body portion of the switch of FIG. 1 with the cover portion removed to expose the contacts and interior portions of the body portion.

Turning now to FIGS. 4 and 5 there is shown the inside of the body portion 22. Two contact chambers 56 flank a central spring chamber 54. The spring chamber 54 ends in two fastener columns 58 each having a central bore 60 which receives fasteners, such as rivets (not shown) passed through apertures 38 in the mounting strap 32. The fastener columns 58 also act as stops for the flat spring 62 (see FIG. 5) which rests upon two supports or ribs 64 which supports the flat spring 62 near its ends and permits it to flex in response to the movement of the toggle lever 26 and establishes the two stable orientations. The flat spring 62 (see FIG. 5) is shorter than the length of spring chamber 54 and the flat spring 62 may be moved between the two stops 58. The flat spring 62 is not permitted to go off of the supports or ribs 64 and remains held above the floor of spring chamber 54.

A first fixed contact member 66 (see FIGS. 6 and 7) has a conductor coupling plate 46, an arm 70 to which is fastened a contact 72 which may be silver or a highly conductive alloy. Contact 72 is fastened to arm 70 by peening the end of contact 72 over arm 70, as at 74, or by brazing, adhesives or other well known attachment mechanisms. A threaded aperture 76 in coupling plate 46 receives the terminal screw 48. Ribs 78 are placed on end wall 80 (see FIG. 4) to position and hold the coupling plates 46 in assembly with the body portion 22 of the switch 20. A post 82 with a groove 84 therein receives a portion of the arm 70 to further support the fixed contact member 66 and ribs on the cap 24 further assist in positioning and holding the coupling plate 46 and contact 70 in place as will be further described below. The second fixed contact member 86 is the mirror image of the first fixed contact member 66.

Figure 8:
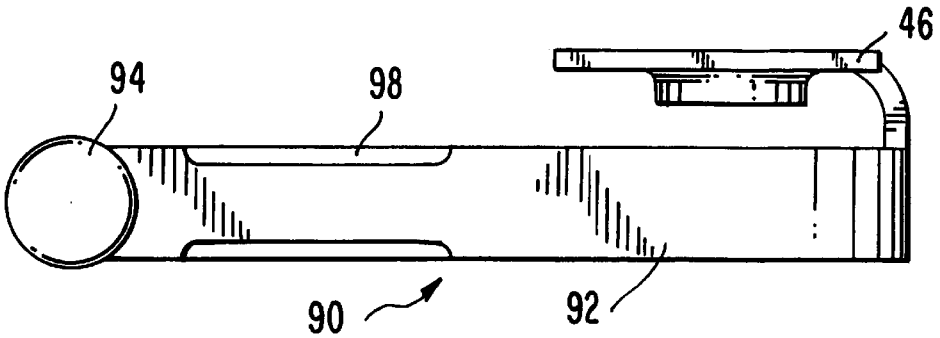
FIG. 8 is a top plan view of a movable contact mounted on a resilient arm with its conductor coupling plate attached.
Figure 9:
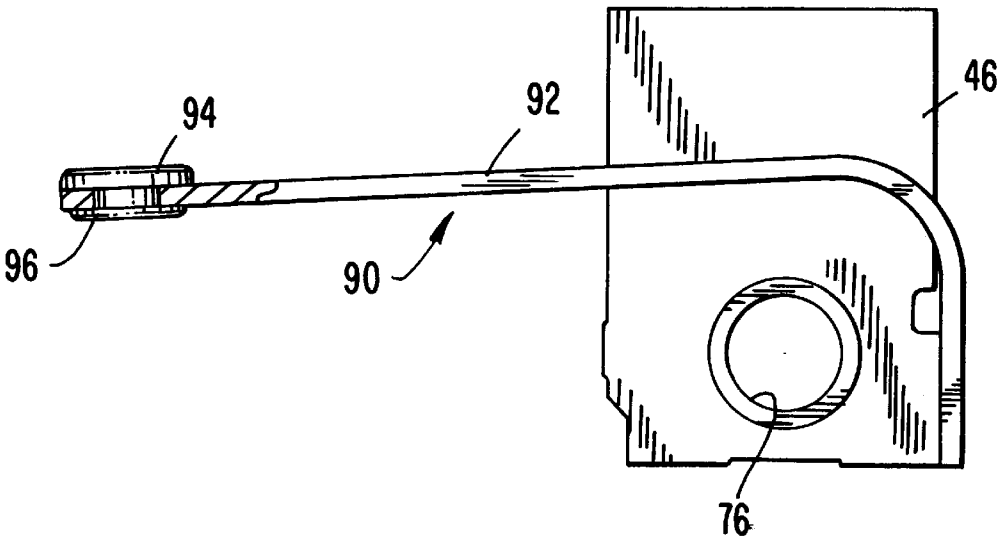
FIG. 9 is a side elevational view, partly in section, of the contact of FIG. 8.

The first movable contact member 90, as seen in FIGS. 8 and 9, has a coupling plate 46 with a threaded aperture 76 therein for receiving a terminal screw 48 and a resilient arm 92 to which is fixed a movable contact 94, which may be of silver or a highly conductive alloy and which is peened over, to connect the movable contact 94 to the resilient arm 92 as at 96. The resilient arm 92 has two cutouts 98 to increase the flexibility of resilient arm 92. An L-shaped rib 100 (see FIG. 4) positions and holds in assembly the coupling plate 46 with the assistance of ribs on the cap 24 to be described below.

The contact member 66 is positioned above the contact member 90 and the resilient arm 92 is biased to cause closure of movable contact 94 with fixed contact 72. This is the normal closed position of the switch 20.

Second movable contact member 102 is the mirror image of the first movable contact member 90.

Cap 24 as shown in FIG. 10 has four projections 104, one adjacent the four corners of the cap 24. Each projection 104 has a rib 106 which contacts a back surface of a corresponding coupling plate 46 to keep the coupling plate 46 in position against the interior of a side wall of the body portion 22. A ledge 108 runs along ribs 110, 112 and 114 and engages the top edge of coupling plates 46 to hold them against the interior surface of the bottom wall of body portion 22. Thus, the coupling plates 46 of the fixed contact members 66 are positioned and held in place by the rib 78, the interior surfaces of the bottom and sidewalls of body portion 22, a rib 106 and a ledge 108 of cap 24. The coupling plates 46 of the movable contact members 90 are positioned and held in place by the L-shaped ribs 100, the interior surfaces of the bottom and side walls of body portion 22, a rib 106 and a ledge 108 of cap 24. The cap 24 has two sets of recesses 116 formed between ribs 118 and 120. The recesses 116 receive the pivot pins of the toggle lever 26 and permit such toggle lever 26 to pivot between the two stable orientations, as will be described below.

Turning now to FIGS. 11 and 12 the toggle lever 26 is described. Actuating portion 28 is at a first end and a flat body portion 121 ending in pointed spring engagement surface 122 is at the second end of toggle lever 26. Two short pivot pins 124 extend outwardly from the approximate midpoint of the toggle lever 26. The two pivot pins 124 are retained in the recesses 116 of cap 24 by the resilient arms 92 of the movable contact members 90 and 102 but are free to rotate within the recesses 116. Two lobes 126 are separated from body portion 121 by stub shafts 128. The position and shape of the lobes 126 are so chosen that when the toggle lever 26 is in a first orientation the movable contacts 94 are in engagement with the fixed contacts 72 and when the toggle lever 26 is moved to a second orientation the movable contacts 94 are moved out of engagement with the fixed contacts 72. The two orientations, limited by stop surfaces 136, 138, may be designated on and off, respectively, and may be marked on toggle lever 26 by nameplates 130, 132. Because of the long tails 134 of the lobes 126, the switch 20 is slow in opening but fast in closing as will be described below.

Referring now to FIGS. 13 and 14 the interior of the body portion 22 is described. Spring chamber 54 is separated from each of the two contact chambers 56 by walls 140 and 142. A first stop 144 is formed in walls 140 and 142 to be engaged by stop surface 138 of the toggle lever 26 to limit the counter-clockwise movement of the toggle lever 26 in FIGS. 13 and 14. A second stop 146 is formed in walls 140 and 142 to be engaged by stop surface 136 of the toggle lever 26 to limit the clockwise movement of toggle lever 26 in FIGS. 13 and 14.

Figure 15:
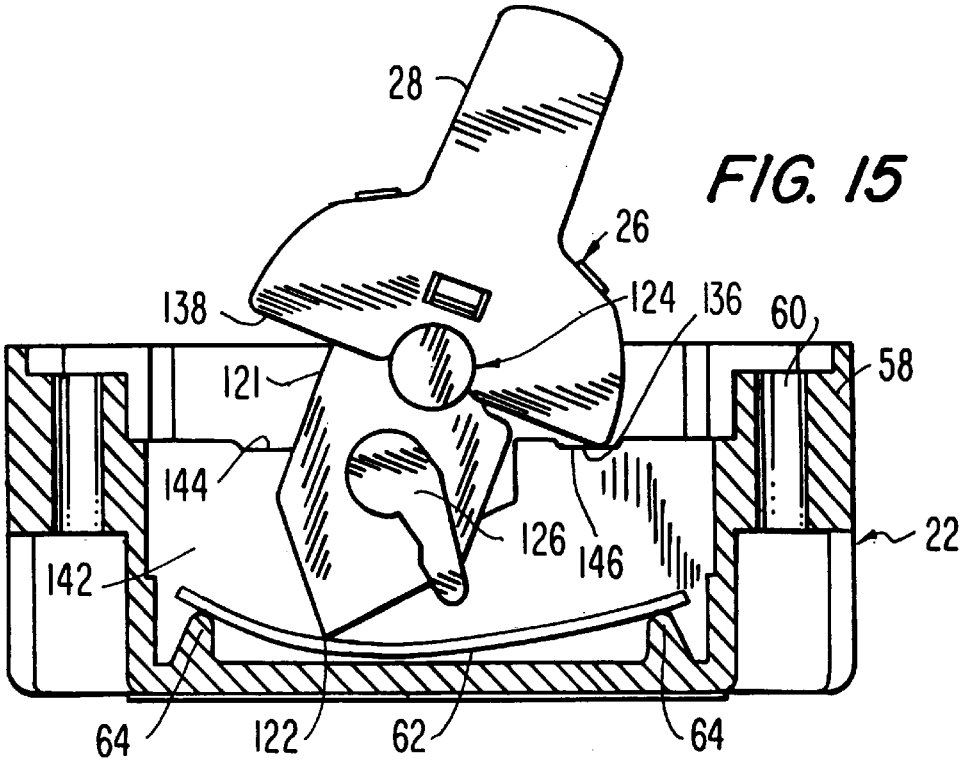
FIG. 15 is similar to FIG. 14 but shows the toggle lever in a first orientation.
Figure 16:
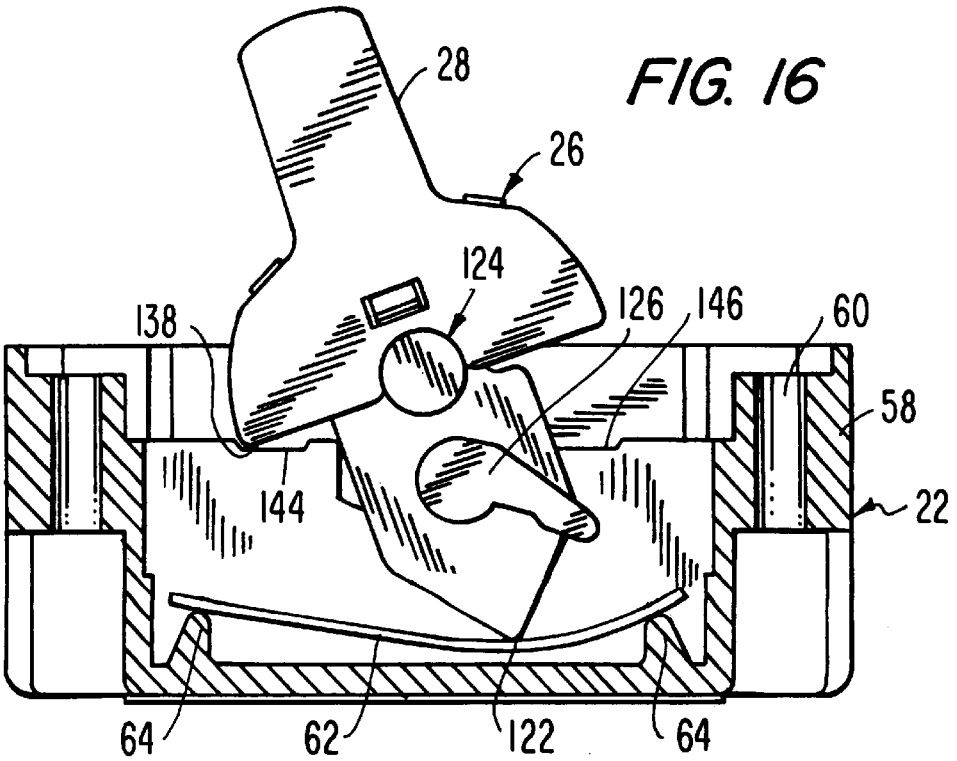
FIG. 16 is similar to FIG. 14 but shows the toggle lever in a second orientation.

FIGS. 15 and 16 show the orientation of the toggle lever 26 with respect to the flat spring 62 deflections. It should be noted that the flat spring 62 is preloaded by the point 122 of the toggle lever 26 when the switch 20 is assembled. This occurs because the length of the toggle lever 26 is such that the flat spring 62 must deflect for the switch 20 to be assembled. In FIG. 15, the toggle lever 26 is in the off position with stop surface 136 in contact with stop 146 and flat spring 62 deflected by the point 122 of toggle lever 26 adjacent the left end of flat spring 62. At this orientation, the toggle lever 26 is stable and will hold its position. By applying a counterclockwise force to actuating portion 28 of toggle lever 26 the position shown in FIG. 16 is achieved. Stop surface 138 is in contact with stop 144 and the on position results. The flat spring 62 is deflected adjacent its right end by the point 122 of the toggle lever 26 and this position is the second orientation of the toggle lever 26.

Figure 17:
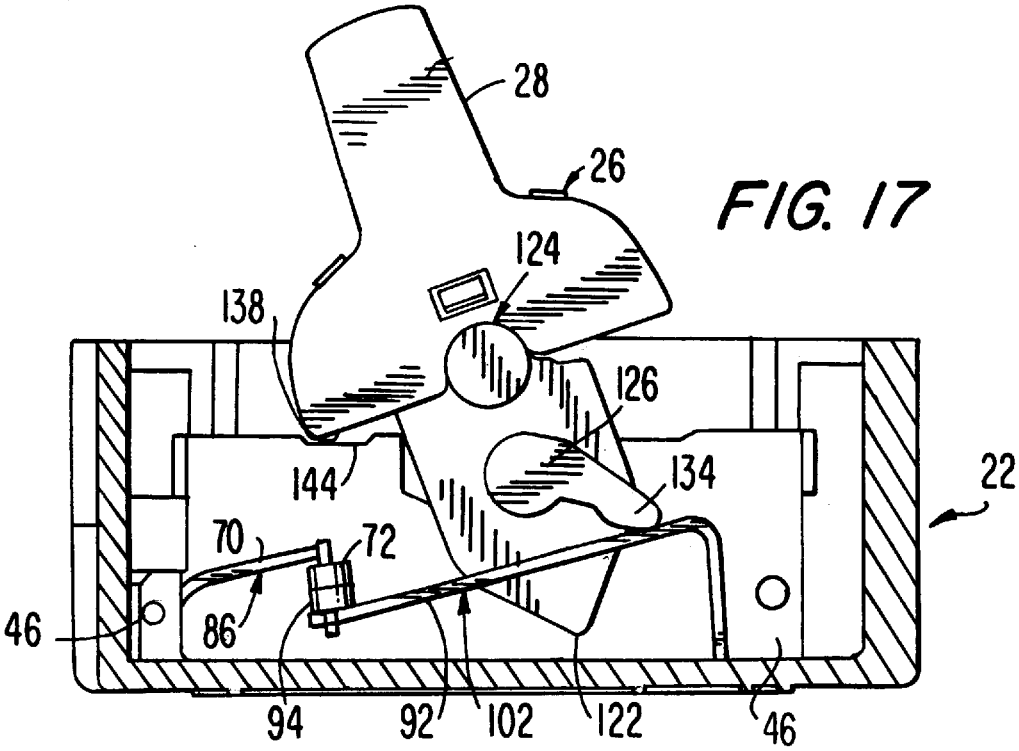
FIG. 17 is a side elevational view of the switch of FIG. 1 taken along the lines 17—17 in FIG. 13 with the toggle lever and contacts in a first position.

Referring now to FIG. 17 the position of the components of switch 20 is shown when the switch 20 is in the on orientation. The actuating portion 28 is at its most counter-clockwise orientation and the flat spring 62 has been deflected adjacent its right end as shown in FIG. 16. The long tails 134 rest upon the resilient arms 92 of the movable contact members 90 and 102 but apply no forces to such arms 92. The movable contacts 94 are in engagement with their associated fixed contacts 72 and the circuits between conductors 1 and 2 and between conductors 3 and 4 are closed.

Figure 18:
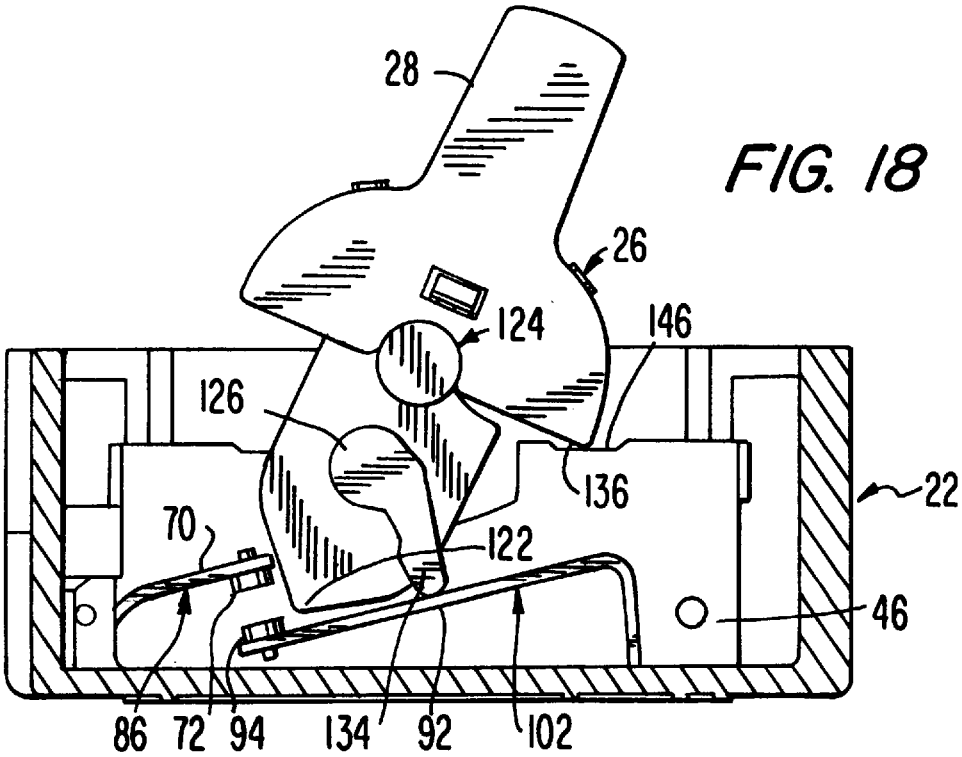
FIG. 18 is similar to FIG. 17 with the toggle lever and contacts in a second position.

FIG. 18 shows the positions of the components of switch 20 when switch 20 is in the off position which opens the connections between conductors 1 and 2 and between 3 and 4 and opens both circuits. The actuating portion 28 of toggle lever 26 is in its most clockwise position and the flat spring 62 has been deflected adjacent its left end as shown in FIG. 15. Because the long tails 134 of the lobes 126 must move along the arms 92 for a significant distance before contacts 72 and 94 part, the switch 20 is a slow opening switch.

In returning from the on orientation of FIG. 17 to the off orientation of FIG. 18, the angle of the long tails 134 with respect to the center line of the toggle lever 26, causes the long tails 134 to rapidly leave the surface of the arms 92 permitting the contacts 77 and 94 to rapidly close characterizing the switch 20 as a rapidly closing switch.

While there have been shown and described and pointed out the fundamental novel features of the invention as applied to the preferred embodiments, as are presently contemplated for carrying them out, it will be understood that various omissions and substitutions and changes of the form and details of the device illustrated and in its operation may be made by those skilled in the art, without departing from the spirit of the invention.

We claim:

1. An electrical switch, comprising:

a) at least one fixed contact;

b) means for connecting said at least one fixed contact to a first electrical conductor;

c) at least one resilient arm, one for each of said at least one fixed contact;

d) at least one movable contact, one for each of said at least one fixed contact, each of said at least one movable contact mounted upon an associated one of said at least one resilient arm;

e) second means for connecting said at least one movable contact to a second electrical conductor;

f) a toggle lever having a first end to be engaged by a user to position said toggle lever of said switch in one of two possible orientations and a second end spaced from said first end by a length of said toggle lever;

g) a flat spring, said second end of said toggle lever engaging said flat spring to deflect said flat spring and establish said two possible orientations of said toggle lever; and h) at least one lobe, one for each of said at least one resilient arm, mounted upon said toggle lever whereby when said toggle lever is in a first orientation of said two possible orientations said lobe moves said resilient arm to permit said at least one movable contact to engage said at least one fixed contact to close a circuit between said first and second electrical conductors and in a second orientation of said two possible orientations said lobe permits said resilient arm to separate said at least one movable contact from said at least one fixed contact and interrupt the circuit between said first and second electrical conductors.

2. An electrical switch, as defined in claim 1, further comprising:

a) a spring chamber to receive said flat spring and said second end of said toggle lever;

b) at least one contact chamber, each of said at least one contact chamber receiving one of said at least one fixed contact and one of said at least one movable contacts; and c) at least one wall separating said spring chamber from said at least one contact chamber.

3. An electrical switch, as defined in claim 2, wherein said flat spring has a predetermined length and said spring chamber has a length greater than said predetermined length whereby said flat spring is free to move in said spring chamber.

4. An electrical switch, as defined in claim 3, further comprising:

a) stops in said spring chamber to limit the movement of said flat spring in said spring chamber.

5. An electrical switch, as defined in claim 2, further comprising:

a) supports in said spring chamber to support ends of said flat spring while permitting said flat spring to flex between said supports.

6. An electrical switch, as defined in claim 2, further comprising:

a) stops in said at least one wall to limit the travel of said toggle lever in each of the two orientations.

7. An electrical switch, as defined in claim 1, wherein said second end of said toggle lever is pointed.

8. A double pole, single throw electrical switch comprising:

a) a housing having a generally central spring chamber, having two spaced apart and parallel side walls and two contact chambers one contact chamber adjacent each of said spring chamber side walls;

b) each wall of said two walls separating said spring chamber and one of said contact chambers;

c) two fixed contacts, one in each of said two contact chambers;

d) first means connecting a first of said two fixed contacts to a first electrical conductor;

e) second means connecting a second of said two fixed contacts to a second electrical conductor;

f) two resilient arms, one in each of said two contact chambers;

g) two movable contacts, a first of said two movable contacts mounted upon a first of said two resilient arms and a second of said two movable contacts mounted upon a second of said two resilient arms;

h) a third means connecting said first of said two movable contacts to a third electrical conductor;

i) a fourth means connecting the second of said two movable contacts to a fourth electrical conductor;

j) a toggle lever having a first end to be engaged by a user to position said toggle lever of said switch in one of two possible orientations and a second end spaced from said first end by a length of said toggle lever;

k) a flat spring, said second end of said toggle lever engaging said flat spring to deflect said flat spring and establish said two possible orientations of said toggle lever; and l) two lobes, one for each of said two resilient arms mounted upon said toggle lever whereby when said toggle lever is in a first of said two possible orientations each of said lobes move one of said two resilient arms to permit said two movable contacts to each engage one of said two fixed contacts to close a first circuit between said first and third electrical conductors and a second circuit between said second and fourth electrical conductors and in a second of said two possible orientations said lobes permit each of said two resilient arms to separate an associated one of said two movable contacts from an associated one of said two fixed contacts and interrupt a circuit between said first and third electrical conductors and said second and fourth electrical conductors.

9. A double pole, single throw switch, as defined in claim 8, wherein said flat spring has a predetermined length between a first end and a second end and said spring chamber has a length, between a first end and a second end, greater than said predetermined length whereby said flat spring is free to move in said spring chamber.

10. A double pole, single throw switch, as defined in claim 8, further comprising:

a) two stops, one at each end of said spring chamber to limit the movement of said flat spring in said spring chamber.

11. A double pole, single throw switch, as defined in claim 9, further comprising:

a) two supports in said spring chamber, one at each end of said spring chamber, to support said first and second ends of said flat spring while permitting said flat spring to flex between and move along said two supports.

12. A double pole, single throw switch, as defined in claim 8, further comprising:

a) stops in said two walls to limit the movement of said toggle lever in each of the two orientations.

13. A double pole, single throw switch, as defined in claim 8, wherein said second end of said toggle lever is pointed.

14. A double pole, single throw switch, as defined in claim 8, wherein said flat spring is pretensioned by the second end of said toggle lever when assembled to said switch.

* * * * *